US006615420B1

(12) United States Patent
Hyden et al.

(10) Patent No.: US 6,615,420 B1
(45) Date of Patent: Sep. 9, 2003

(54) BATHING CHAIR AND METHOD OF USING

(76) Inventors: Larry Hyden, 5853 W. Kingfisher Dr., Mentone, IN (US) 46539; Richard Ault, 9651 W. 1200 S., Akron, IN (US) 46910

( * ) Notice: Subject to any disclaimer, the term of this patent is extended or adjusted under 35 U.S.C. 154(b) by 0 days.

(21) Appl. No.: 10/144,351

(22) Filed: May 13, 2002

(51) Int. Cl.[7] ..... A47K 3/12

(52) U.S. Cl. ..... 4/579; 4/578.1; 4/560.1; 4/571.1; 4/579; 4/573.1

(58) Field of Search ..... 4/560.1, 571.1, 4/578.1, 573.1, 579

(56) References Cited

U.S. PATENT DOCUMENTS

| | | | | | |
|---|---|---|---|---|---|
| 2,052,628 | A | * | 9/1936 | Higgins | 4/578.1 |
| 4,520,515 | A | * | 6/1985 | Hatala | 4/579 |
| 5,097,542 | A | * | 3/1992 | Roesler | 4/579 |
| 5,361,428 | A | * | 11/1994 | Nanowsky et al. | 4/558 |
| 5,465,437 | A | * | 11/1995 | Herman | 4/611 |
| 5,517,704 | A | * | 5/1996 | Dagostino | 4/560.1 |
| 5,822,809 | A | * | 10/1998 | Gallo | 4/578.1 |
| 5,887,297 | A | * | 3/1999 | Sutor | 4/578.1 |

* cited by examiner

*Primary Examiner*—Gregory Huson
*Assistant Examiner*—Azy Kokabi

(57) ABSTRACT

A new and improved bathing chair and method of using the bathing chair for positionment within a bathtub is described. The bathing chair having a generally U-shaped framework comprising a seat; a support rod; a pair of U-shaped frame members; a pair of caps; a pair of bottom support members; a pair of top support members; a base member; a yoke member; and a collar. The support rod has a generally S-shaped configuration, in which the top end of the support rod is pivotally attached to the seat. Each of the U-shaped frame members has an upside down J-shaped configuration at the proximate end and an upside down L-shaped configuration at the distal end. The pair of caps are attached to the distal ends of the pair of U-shaped frame members. The pair of bottom support members are connected the bottom portions of each U-shaped frame members together. The pair of top support members are connected to the top portions of each U-shaped frame members together. The base member is connected to the middle bottom portions of each U-shaped frame member together. The yoke member is connected to the middle sections of the top support members together. The yoke member having an orifice in which support rod rotatably engages with the orifice of the yoke member. Finally, the collar is attached to the base member, in which the collar is pivotally attached to the bottom end of the support rod. The method of using the new and improved bathing chair comprises the steps of obtaining; positioning; aligning; adjusting; sitting; lifting; pivoting; washing; raising; rotating; and standing.

9 Claims, 3 Drawing Sheets

BATHING CHAIR AND METHOD OF USING

FIELD OF THE INVENTION

The present invention relates to devices for assisting infirm and elderly persons, more particularly to a bathing chair for allowing a person safely enter and exit from a bathtub environment so that the person may be washed.

DESCRIPTION OF THE PRIOR ART

There is a great, current awareness now on the part of the public concerning the special needs of physically handicapped persons. Widespread recognition of the need to accommodate the handicapped and to provide them with appropriate means for enjoying the modern lifestyle has long been recognized. Public and commercial buildings have been modified to allow handicapped individuals into these buildings. Specially equipped elevators, low-level water fountains, and rest rooms equipped with safety fixtures are only but a few examples of how society has responded to the special needs of handicapped, infirm or elderly persons.

For decades, the bathroom has continued to present itself as the most likely room within a home where a person will be injured. Part of the danger associated with the bathroom environment is the presence of the bathtub that poses a serious threat of slipping going in and out of the bathtub. Therefore, it is no surprise that a wide variety of bathing chairs is currently available on the commercial market and an even larger number of these types of devices are known in the art of bathing chairs, for example, the shower bath chair for use in conjunction with a bathtub disclosed by Bailey in U.S. Pat. No. 4,150,445; the bathing appliance for handicapped persons disclosed by Herman in U.S. Pat. No. 5,465,437; the transfer seat apparatus disclosed by Gallo in U.S. Pat. No. 5,822,809; the bathtub shower adjustable seat disclosed by Sutor in U.S. Pat. No. 5,887,297; the bathing chair disclosed by Hill in U.S. Pat. No. 6,279,178B1; and the bathing aid for the elderly/disabled disclosed by Newick in U.S. Pat. No. D392,808. While all of the above-described devices fulfill their respective, particular objectives and requirements, the aforementioned patents do not describe a bathing chair having a generally U-shaped framework design having a pair of U-shaped frame members in which each frame member has an upside down J-shaped configuration at the proximate end and an upside down L-shaped configuration at the distal end. This design would specifically match the user's particular individual needs of making it possible to conveniently position the bathing chair in a safe and secure position within the bathtub because the J-shaped and the L-shaped ends aid in stabilizing the bathing chair.

Therefore, a need exist for a new and improved bathing chair that can be used for making it possible to conveniently position the bathing chair in a safe and secure position within the bathtub so that a bather may conveniently and safely enter and exit into a bathtub environment. Therefore, a bathing chair having a generally U-shaped framework design having a pair of U-shaped frame members in which each frame member has an upside down J-shaped configuration at the proximate end and an upside down L-shaped configuration at the distal end would be desirable because the J-shaped and the L-shaped ends could aid in stabilizing the bathing chair. In this respect, the bathing chair according to the present invention substantially departs from the conventional concepts and designs of the prior art, and in doing so provides an apparatus primarily developed for the purpose of affording a bather a safe and convenient means of entering and exiting from a bathtub environment.

SUMMARY OF THE INVENTION

The present device, according to the principles of the present invention, overcomes the shortcomings of the prior art by providing a bathing chair having a generally U-shaped framework comprising a seat; a support rod; a pair of U-shaped frame members; a pair of caps; a pair of bottom support members; a pair of top support members; a base member; a yoke member; and a collar. The support rod has a generally S-shaped configuration, in which the top end of the support rod is pivotally attached to the seat. Each of the U-shaped frame members has an upside down J-shaped configuration at the proximate end and an upside down L-shaped configuration at the distal end. The pair of caps are attached to the distal ends of the pair of U-shaped frame members. The pair of bottom support members are connected the bottom portions of each U-shaped frame members together. The pair of top support members connect together the top portions of each U-shaped frame members to each other. The base member connects together to the middle bottom portions of each U-shaped frame member to each other. The yoke member connect together the middle sections of the top support members to each other. The yoke member has an orifice in which the support rod rotatably engages within the orifice of the yoke member. Finally, the collar is attached to the base member, in which the collar is pivotally attached to the bottom end of the support rod.

In view of the foregoing disadvantages inherent in the known type bathing chairs now present in the prior art, the present invention provides an improved bathing chair, which will be described subsequently in great detail, is to provide a new and improved bathing chair which is not anticipated, rendered obvious, suggested, or even implied by the prior art, either alone or in any combination thereof.

To attain this, the present invention essentially comprises a support rod that has a generally S-shaped configuration, in which the top end of the support rod is pivotally attached to the seat. Each of the U-shaped frame members has an upside down J-shaped configuration at the proximate end and an upside down L-shaped configuration at the distal end. The pair of caps are attached to the distal ends of the pair of U-shaped frame members. The pair of bottom support members are connected the bottom portions of each U-shaped frame members together. The pair of top support members are connected to the top portions of each U-shaped frame members together. The base member is connected to the middle bottom portions of each U-shaped frame member together. The yoke member is connected to the middle sections of the top support members together. The yoke member having an orifice in which support rod rotatably engages with the orifice of the yoke member. Finally, the collar is attached to the base member, in which the collar is pivotally attached to the bottom end of the support rod.

There has thus been outlined, rather broadly, the more important features of the invention in order that the detailed description thereof that follows may be better understood, and in order that the present contribution of the art may be better appreciated.

The invention may also include a back support, headrest, armrest and a seat belt attached to the seat. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bathing chair that has all the advantages of the prior art bathing chair and none of the disadvantages.

It is another object of the present invention to provide a new and improved bathing chair that may be easily and efficiently manufactured and marketed.

An even further object of the present invention is to provide a new and improved bathing chair that has a low cost of manufacture with regard to both materials and labor, and which accordingly is then susceptible of low prices of sale to the consuming public, thereby making such multipurpose storage unit and system economically available to the buying public.

Still another object of the present invention is to provide a new bathing chair that provides in the apparatuses and methods of the prior art some of the advantages thererof, while simultaneously overcoming some of the disadvantages normally associated therewith.

Even still another object of the present invention is to provide a bathing chair having a generally U-shaped framework design having a pair of U-shaped frame members in which each frame member has an upside down J-shaped configuration at the proximate end and an upside down L-shaped configuration at the distal end. This design makes it possible to conveniently position the bathing chair in a safe and secure position within the bathtub because the J-shaped and the L-shaped ends aid in stabilizing the bathing chair.

Lastly, it is an object of the present invention to provide a new and improved method of using this new and improved bathing chair is described. The method of using the new and improved bathing chair comprises the steps of obtaining, positioning, aligning, adjusting, sitting, lifting, pivoting, washing, raising, rotating, and standing.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompany drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
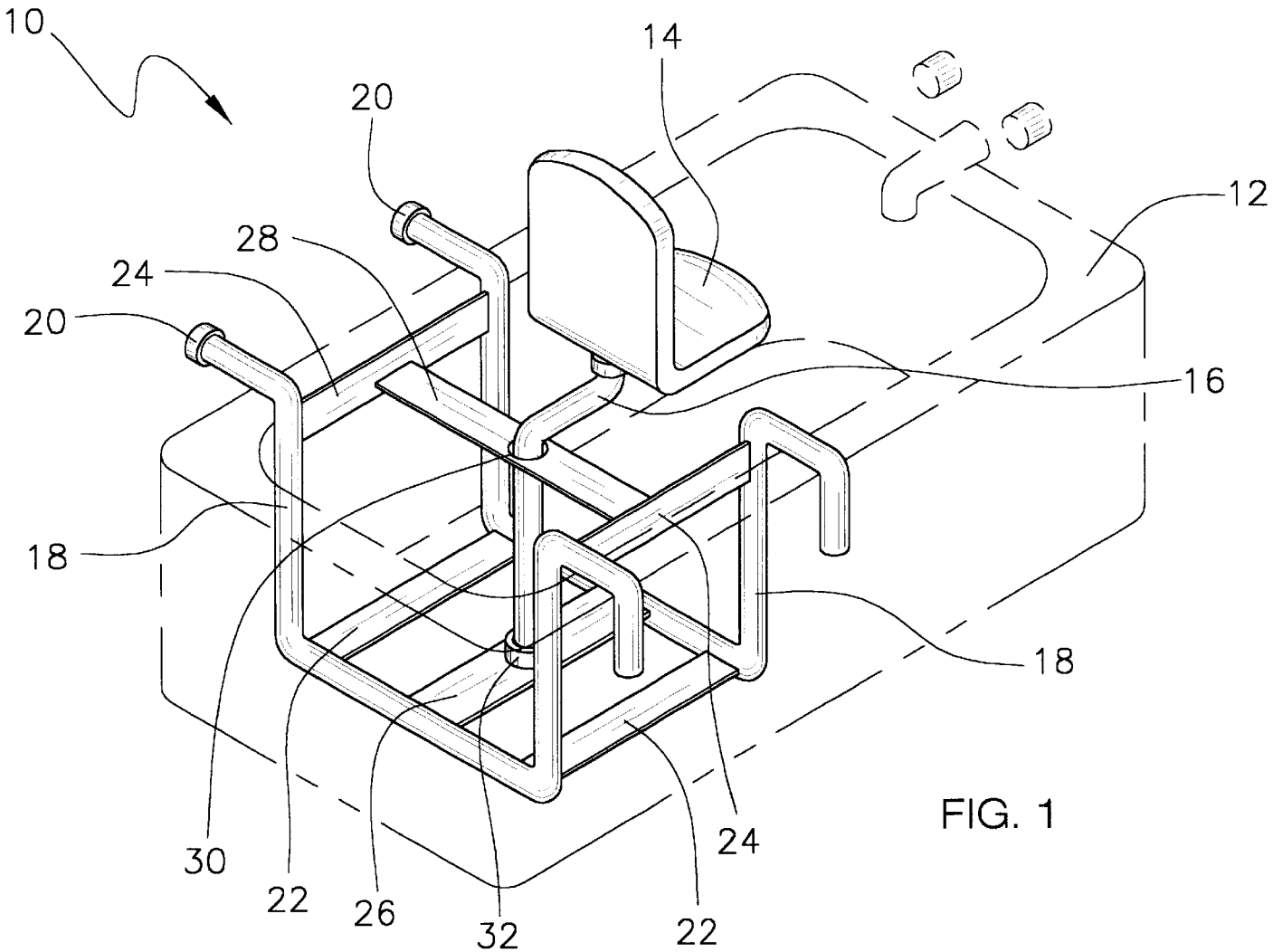
FIG. 1 is a perspective view of a preferred embodiment of the bathing chair constructed in accordance with the principles of the present invention.

Referring now to the drawings, and in particular FIGS. 1 to 4 thereof, one preferred embodiment of the present invention is shown and generally designated by the reference numeral 10. One preferred embodiment of the present invention of a bathing chair 10 having a generally U-shaped framework for positionment within a bathtub 12, the bathing chair 10 comprises: a seat 14; a support rod 16; a pair of U-shaped frame members 18; a pair of caps 20; a pair of bottom support members 22; a pair of top support members 24; a base member 26; a yoke member 28; and a collar 32. The support rod 16 has a generally S-shaped configuration, in which the top end of the support rod 16 is pivotally attached to the seat 14. Each of the U-shaped frame members 18 have an upside down J-shaped configuration at the proximate end and an upside down L-shaped configuration at the distal end. The pair of caps 20 are attached to the distal ends of the pair of U-shaped frame members 18. The pair of bottom support members 22 are connected the bottom portions of each U-shaped frame members 18 together. The pair of top support members 24 are connected to the top portions of each U-shaped frame members 18 together. The base member 26 is connected to the middle bottom portions of each U-shaped frame member 18 together. The yoke member 28 is connected to the middle sections of the top support members 24 together. The yoke member 28 has an orifice 30 in which support rod 16 rotatably engages with the orifice 30 of the yoke member 28. Finally, the collar 32 is attached to the base member 26, in which the collar 32 is pivotally attached to the bottom end of the support rod 16.

Another preferred embodiment of the bathing chair 10 comprises a seat 14; a support rod 16; a pair of U-shaped frame members 18; a pair of caps 20; a pair of bottom support members 22; a pair of top support members 24; a base member 26; a yoke member 28; a collar 32 and a pair of bolts 34. The seat 14 comprising: a bottom member; a back member, wherein the back member is pivotally attached to the bottom member; a pair of arm rest attached to opposite sides of the bottom member; and a head rest attached to the back member. The support rod 16 has a generally S-shaped configuration, in which the top end of the support rod 16 pivotally attached to the seat 14. Each of the pair of U-shaped frame members 18 has an upside down J-shaped configuration at the proximate end and an upside down L-shaped configuration at the distal end. The pair of caps 20 attached to the distal ends of the pair of U-shaped frame members 18. The pair of bottom support members 22 connecting the bottom portions of each U-shaped frame members 18 together. The pair of top support members 24 connecting the top portions of each U-shaped frame members 18 together. The base member 26 connecting the middle bottom portions of each U-shaped frame member 18 together. The yoke member 28 connects together the middle sections of the top support members 24. The yoke member 28 has an orifice 30, wherein the support rod 16 rotatably engages with the orifice 30 of the yoke member 28. The collar 32 attached to the base member 26. The collar 32 pivotally attached to the bottom end of the support rod 16. Finally, a pair of bolts 34 for attachment of the bathing chair 10 to a wall 36 adjacent to the bathtub 12.

The seat 14 may optionally comprise a bottom member and a back member. The optional back member may be pivotally attached to the bottom member to afford the bather a more comfortable experience while bathing. The seat may further comprising an optional pair of arm rests attached to opposite sides of the bottom member. Finally the seat may further comprise a seat belt attached to the seat 14 for use in safely securing the bather onto the seat. The seat may further comprise a head rest attached to the back member for supporting the head of the bather.

An optional pair of bolts 34 may be added to the bathing chair 10 for attachment of the bathing chair 10 to a wall 36 adjacent to the bathtub 12.

One preferred embodiment of the method of using the bathing chair 10 comprises the steps of: obtaining; positioning; aligning; adjusting; sitting; lifting; pivoting; washing; raising; rotating; and standing. The obtaining step comprises obtaining a bathing chair 10 having a generally U-shaped framework for positionment within a bathtub 12, the bathing chair 10 comprises: a seat 14; a support rod 16 having a generally S-shaped configuration, the top end of the support rod 16 pivotally attached to the seat 14; a pair of U-shaped frame members 18 each U-shaped frame member 18 having an upside down J-shaped configuration at the proximate end and an upside down L-shaped configuration at the distal end; a pair of caps 20 attached to the distal ends of the pair of U-shaped frame members 18; a pair of bottom support members 22 connecting the bottom portions of each U-shaped frame members 18 together; a pair of top support members 24 connecting the top portions of each U-shaped frame members 18 together; a base member 26 connecting the middle bottom portions of each U-shaped frame member 18 together; a yoke member 28 connecting the middle sections of the top support members 24 together, the yoke member 28 having an orifice 30, wherein the support rod 16 rotatably engages with the orifice 30 of the yoke member 28; and a collar 32 attached to the base member 26, the collar 32 pivotally attached to the bottom end of the support rod 16. The positioning step comprises positioning the bathing chair 10 inside a bathtub 12. The aligning step comprises aligning the seat 14 towards the side of the bathtub 12. The adjusting step comprises adjusting a bather next to the bathtub 12 by having the bather's feet point away from the bathtub 12. The sitting step comprises sitting down on the seat 14 by the bather. The lifting step comprises lifting the bather's feet above the side of the bathtub 12. The pivoting step comprises pivoting the bather sitting on the seat 14 so that the bather's feet point toward the front of the bathtub 12. The washing step comprises washing the bather while sitting on the seat 14. The raising step comprises raising the bather's feet above the side of the bathtub 12. The rotating step comprises rotating the bather sitting on the seat 14 so that the bather's feet extend away from the bathtub 12. The standing step comprises standing the bather up and away from the seat 14.

Referring now to FIG. 1, which depicts a perspective view of a preferred embodiment of the bathing chair 10, the bathing chair 10 has a generally U-shaped framework for positionment within a bathtub 12. The support rod 16 has a generally S-shaped configuration, in which the top end of the support rod 16 is pivotally attached to the seat 14. Each of the U-shaped frame members 18 has an upside down J-shaped configuration at the proximate end and an upside down L-shaped configuration at the distal end. The upside down J-shaped configuration of each frame member 18 aids in stabilizing the bathing chair 10 when positioned within a bathtub 12. The pair of caps 20 are attached to the distal ends of the pair of U-shaped frame members 18. The pair of caps 20 aid in stabilizing the bathing chair 10 by being able to abut against a wall 36 adjacent to the bathtub 12. The pair of bottom support members 22 are connected the bottom portions of each U-shaped frame members 18 together. The pair of top support members 24 are connected to the top portions of each U-shaped frame members 18 together. The base member 26 is connected to the middle bottom portions of each U-shaped frame member 18 together. The yoke member 28 is connected to the middle sections of the top support members 24 together. The yoke member 28 having an orifice 30 in which support rod 16 rotatably engages with the orifice 30 of the yoke member 28. Finally, the collar 32 is attached to the base member 26, in which the collar 32 is pivotally attached to the bottom end of the support rod 16.

Figure 2:
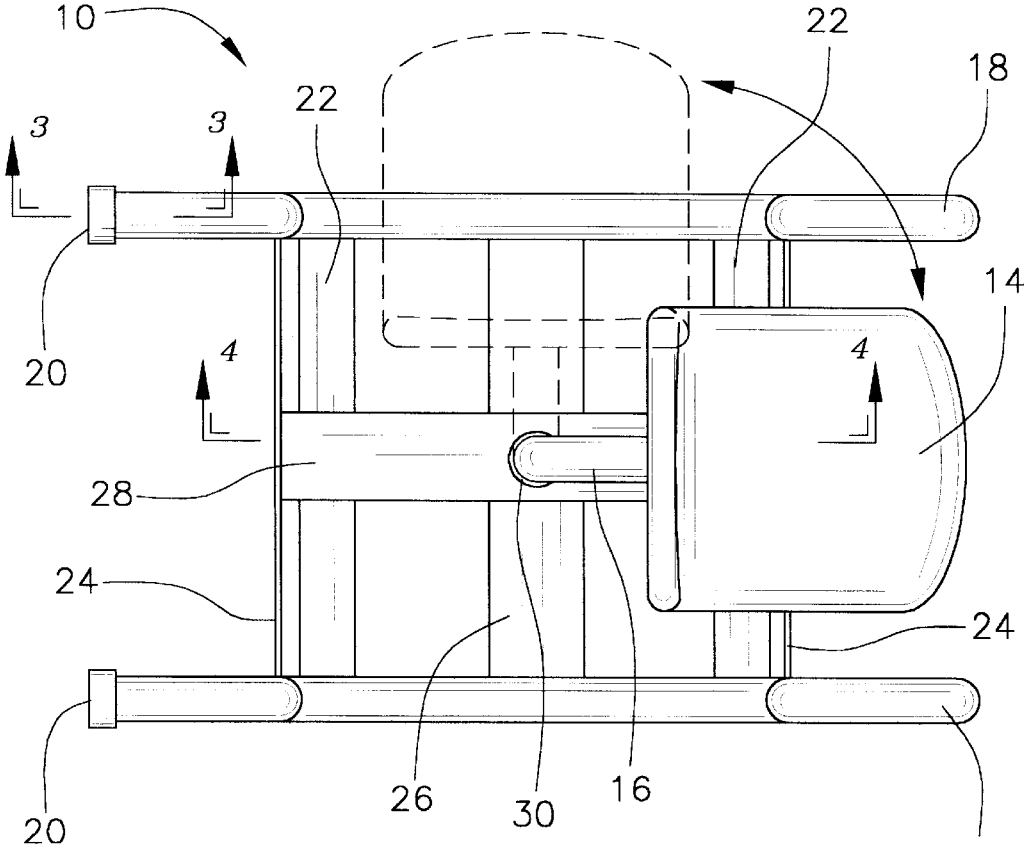
FIG. 2 is a top view of the bathing chair of the present invention.

Referring now to FIG. 2 which depicts a top view of one preferred embodiment of the bathing chair of the present invention, shows the seat 14 is free to rotate around the central pivot point defined by the orifice 30 of the yoke member 28. The seat 14 is also free to rotate around the pivotal attachment point to the support rod 16.

Figure 3:
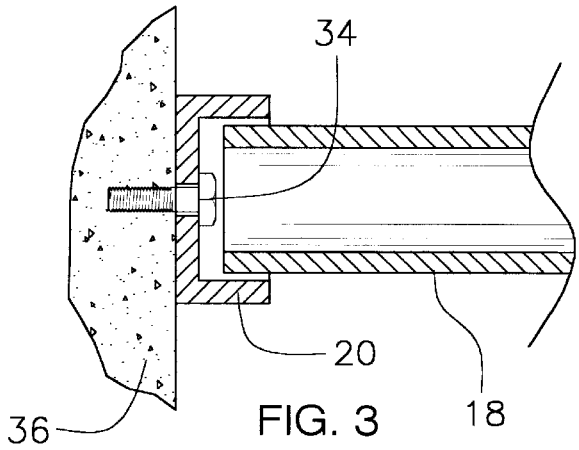
FIG. 3 is a cross sectional view of the cap and bolt of the bathing chair of the present invention attached to a wall.

Referring now to FIG. 3 depicts is a cross sectional view of the cap and bolt of the bathing chair of the present invention attached to a wall, which illustrates that the bathing chair 10 may be permanently mounted onto a wall 36 adjacent to the bathtub 12 by a pair of bolts 34 securing the pair of caps 20 onto the wall 36.

Figure 4:
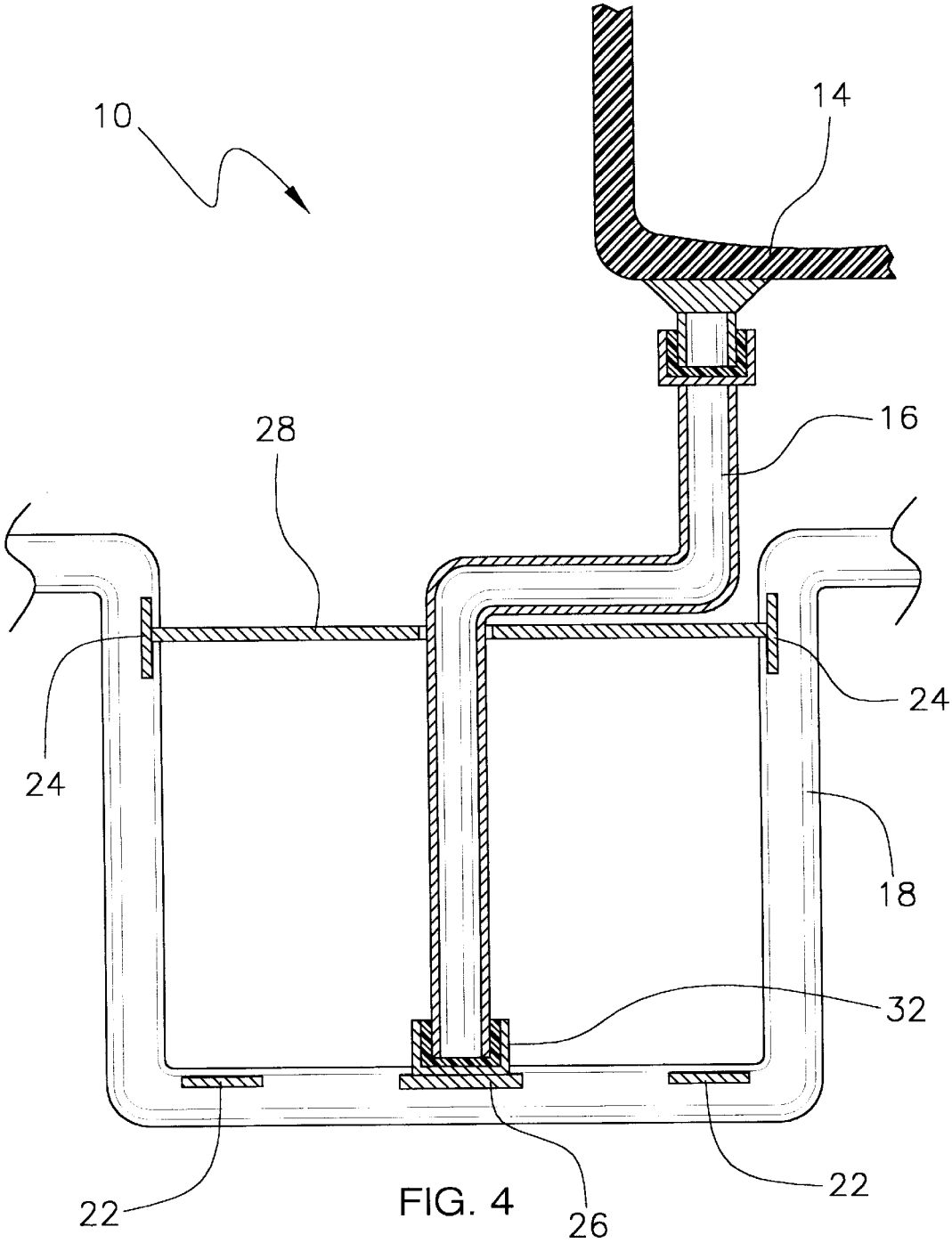
FIG. 4 is a cross sectional view of a preferred embodiment of the bathing chair of the present invention.

Referring now to FIG. 4 which depicts a cross sectional view of the a preferred embodiment of the bathing chair 10. The bathing chair 10 has a generally U-shaped framework for positionment within a bathtub 12. The support rod 16 has a generally S-shaped configuration, in which the top end of the support rod 16 is pivotally attached to the seat 14. The pair of bottom support members 22 are connected the bottom portions of each U-shaped frame members 18 together. The pair of top support members 24 are connected to the top portions of each U-shaped frame members 18 together. The base member 26 is connected to the middle bottom portions of each U-shaped frame member 18 together. The yoke member 28 is connected to the middle sections of the top support members 24 together. The yoke member 28 has an orifice 30 in which support rod 16 rotatably engages with the orifice 30 of the yoke member 28.

Finally, the collar 32 is attached to the base member 26, in which the collar 32 is pivotally attached to the bottom end of the support rod 16.

As to the manner of usage and operation of the present invention, the same should be apparent from the above description. Accordingly, no further discussion relating to the manner of usage and operation will be provided.

While a preferred embodiment of the bathing chair has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bathing chair having a generally U-shaped framework for positionment within a bathtub, said bathing chair comprising:

a seat;

a support rod having a generally S-shaped configuration, the top end of said support rod pivotally attached to said seat;

a pair of U-shaped frame members each U-shaped frame member having an upside down J-shaped configuration at the proximate end and an upside down L-shaped configuration at the distal end;

a pair of caps attached to the distal ends of said pair of U-shaped frame members;

a pair of bottom support members connecting the bottom portions of each U-shaped frame members together;

a pair of top support members connecting the top portions of each U-shaped frame members together;

a base member connecting the middle bottom portions of each U-shaped frame member together;

a yoke member connecting the middle sections of the top support members together, said yoke member having an orifice, wherein said support rod rotatably engages with said orifice of said yoke member; and a collar attached to said base member, said collar pivotally attached to the bottom end of said support rod.

2. The bathing chair described in claim 1 wherein said seat comprises a bottom member and a back member.

3. The bathing chair described in claim 2 wherein said back member is pivotally attached to the seat member.

4. The bathing chair described in claim 2 wherein said seat further comprising a pair of arm rest attached to opposite sides of said bottom member.

5. The bathing chair described in claim 2 further comprising a seat belt attached to said seat member.

6. The bathing chair described in claim 2 further comprising a head rest attached to said back member.

7. The bathing chair described in claim 1 further comprising a pair of bolts for attachment of said bathing chair to a wall adjacent to the bathtub.

8. A bathing chair having a generally U-shaped framework for positionment within a bathtub, said bathing chair comprising:

a seat comprising:

a bottom member;

a back member, wherein said back member is pivotally attached to the seat member;

a pair of arm rest attached to opposite sides of said bottom member; and a head rest attached to said back member;

a support rod having a generally S-shaped configuration, the top end of said support rod pivotally attached to said seat;

a pair of U-shaped frame members each U-shaped frame member having an upside down J-shaped configuration at the proximate end and an upside down L-shaped configuration at the distal end;

a pair of caps attached to the distal ends of said pair of U-shaped frame members; a pair of bottom support members connecting the bottom portions of each U-shaped frame members together;

a pair of top support members connecting the top portions of each U-shaped frame members together;

a base member connecting the middle bottom portions of each U-shaped frame member together;

a yoke member connecting the middle sections of the top support members together, said yoke member having an orifice, wherein said support rod rotatably engages with said orifice of said yoke member;

a collar attached to said base member, said collar pivotally attached to the bottom end of said support rod; and a pair of bolts for attachment of said bathing chair to a wall adjacent to the bathtub.

9. A method of using a bathing chair comprising obtaining a bathing chair having a generally U-shaped framework for positionment within a bathtub, the bathing chair comprising:

a seat;

a support rod having a generally S-shaped configuration, the top end of the support rod pivotally attached to the seat;

a pair of U-shaped frame members each U-shaped frame member having an upside down J-shaped configuration at the proximate end and an upside down L-shaped configuration at the distal end;

a pair of caps attached to the distal ends of the pair of U-shaped frame members;

a pair of bottom support members connecting the bottom portions of each U-shaped frame members together;

a pair of top support members connecting the top portions of each U-shaped frame members together;

a base member connecting the middle bottom portions of each U-shaped frame member together;

a yoke member connecting the middle sections of the top support members together, the yoke member having an orifice, wherein the support rod rotatably engages with the orifice of the yoke member; and a collar attached to the base member, the collar pivotally attached to the bottom end of the support rod;

positioning the bathing chair inside a bathtub;

aligning the seat towards the side of the bathtub;

adjusting a bather next to the bathtub by having the bather's feet point away from the bathtub;

sitting down on the seat by the bather;

lifting the bather's feet above the side of the bathtub;

pivoting the bather sitting on the seat so that the bather's feet point toward the front of the bathtub;

washing the bather while sitting on the seat;

raising the bather's feet above the side of the bathtub;

rotating the bather sitting on the seat so that the bather's feet extend away from the bathtub; and standing the bather up and away from the seat.

* * * * *